US008857909B2

(12) United States Patent
Bock

(10) Patent No.: US 8,857,909 B2
(45) Date of Patent: Oct. 14, 2014

(54) CHAIR WITH A ROCKING MECHANISM

(75) Inventor: Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 84 days.

(21) Appl. No.: 13/567,229

(22) Filed: Aug. 6, 2012

(65) Prior Publication Data

US 2013/0033078 A1 Feb. 7, 2013

(30) Foreign Application Priority Data

Aug. 4, 2011 (DE) ..... 10 2011 109 374

(51) Int. Cl.

| | |
|---|---|
| ***A47C 3/026*** | (2006.01) |
| ***A47C 1/024*** | (2006.01) |
| ***A47C 7/44*** | (2006.01) |
| ***A47C 3/30*** | (2006.01) |
| ***A47C 1/026*** | (2006.01) |

(52) U.S. Cl.

CPC ..... *A47C 1/026* (2013.01); *A47C 3/026* (2013.01); *A47C 7/443* (2013.01); *A47C 3/30* (2013.01)

USPC ..... 297/302.2; 297/258.1; 297/344.12

(58) Field of Classification Search

CPC ..... A47C 1/03255; A47C 3/026; A47C 1/03266; A47C 1/03272; A47C 7/441; A47C 1/03261; A47C 3/30; A47C 3/20

USPC ..... 297/258.1, 270.2, 302.1, 302.2, 302.4, 297/302.5, 303.1, 303.4, 344.12

See application file for complete search history.

(56) References Cited

U.S. PATENT DOCUMENTS

| | | | | |
|---|---|---|---|---|
| 4,328,943 | A * | 5/1982 | Eldon, III | 248/578 |
| 4,892,354 | A | 1/1990 | Estkowski et al. | |
| 5,348,371 | A | 9/1994 | Miotto | |
| 5,658,045 | A | 8/1997 | Van Koolwijk et al. | |
| 5,810,439 | A | 9/1998 | Roslund, Jr. | |
| 6,027,169 | A | 2/2000 | Roslund, Jr. | |
| 6,045,187 | A * | 4/2000 | Stumpf | 297/344.19 |
| 6,120,096 | A | 9/2000 | Miotto | |
| 6,213,552 | B1 * | 4/2001 | Miotto | 297/300.5 |
| 6,276,755 | B1 * | 8/2001 | Su | 297/285 |

(Continued)

FOREIGN PATENT DOCUMENTS

| | | |
|---|---|---|
| DE | 41 28 377 C1 | 10/1992 |
| DE | 44 36 145 A1 | 4/1996 |

(Continued)

*Primary Examiner* — Sarah B McPartlin

(74) *Attorney, Agent, or Firm* — Laurence A. Greenberg; Werner H. Stemer; Ralph E. Locher

(57) ABSTRACT

A chair has a rocking mechanism with a fixed base support having a conical receptacle to be placed on a chair pillar. The base support is pivotally connected to a mechanism upper part which forms a housing at least partially enclosing the base support. A pivot axis of the mechanism upper part runs transversely to the chair longitudinal direction and is arranged next to the conical receptacle, as seen in the chair longitudinal direction. A spring element acts between the mechanism upper part and the base support for returning the mechanism upper part from a pivoted position into a starting position. The rocking mechanism is fastened via the mechanism upper part to a seat, a seat support, or a frame of the chair, or else, the rocking mechanism is integrated so that part of the seat, seat support or chair frame forms the mechanism upper part.

6 Claims, 12 Drawing Sheets

(56) References Cited

U.S. PATENT DOCUMENTS

| | | | | |
|---|---|---|---|---|
| 6,523,897 | B2 * | 2/2003 | Pan | 297/302.1 |
| 7,396,080 | B2 | 7/2008 | Suhr et al. | |
| 7,396,081 | B2 * | 7/2008 | Matern et al. | 297/344.19 |
| 8,388,066 | B2 * | 3/2013 | Allison et al. | 297/344.19 |
| 2005/0173958 | A1 * | 8/2005 | De Martin | 297/300.5 |
| 2005/0218707 | A1 | 10/2005 | Suhr et al. | |

FOREIGN PATENT DOCUMENTS

| | | | |
|---|---|---|---|
| DE | 20 2004 005 366 | U1 | 6/2004 |
| DE | 102007021782 | B3 | 9/2008 |
| EP | 0 405 767 | A1 | 1/1991 |
| EP | 0 806 165 | A2 | 11/1997 |
| EP | 1989961 | A1 | 11/2008 |

* cited by examiner

CHAIR WITH A ROCKING MECHANISM

CROSS-REFERENCE TO RELATED APPLICATION

This application claims the priority, under 35 U.S.C. §119, of German patent application DE 10 2011 109 374.9, filed Aug. 4, 2011; the prior application is herewith incorporated by reference in its entirety.

BACKGROUND OF THE INVENTION

Field of the Invention

The invention relates to a chair with a rocking mechanism, such as a visitor chair or conference chair.

Rocking mechanisms are known from the prior art. They involve subassemblies of comparatively simple construction in the seat substructure of chairs, in which the backrest support is connected rigidly to the seat support, the seat or the frame of the chair. The resultant combination of seat support and backrest support is pivotable rearwards about a pivot axis running transversely with respect to the chair longitudinal direction by means of the rocking mechanism when the user of the chair leans against the backrest. Rocking mechanisms of this type are often used instead of synchronizing mechanisms in expensive visitor or conference chairs, in order to realize a simple rocking function therein.

Despite the fact that rocking mechanisms of that type frequently are of very simple construction, they are nevertheless not constructed in a very space-saving manner, generally for cost reasons. On the contrary, they frequently require a comparatively large construction space, and therefore can be recognized in the seat substructure as a subassembly which is clearly visible from the outside. This results in disadvantages both aesthetically and structurally.

SUMMARY OF THE INVENTION

It is accordingly an object of the invention to provide a rocking mechanism for a chair and a chair with the novel rocking mechanism which overcomes the above-mentioned disadvantages of the heretofore-known devices and methods of this general type and which provides for a chair which has a structurally particularly simple and nevertheless small rocking mechanism.

With the foregoing and other objects in view there is provided, in accordance with the invention, a chair with a rocking mechanism. The assembly comprises:

a rocking mechanism having a fixed base support with a conical receptacle formed for placing said base support on a chair pillar of the chair;

a mechanism upper part pivotally connected to said base support, said mechanism upper part forming a housing at least partially enclosing said base support;

said mechanism upper part being pivotable about a pivot axis running transversely with respect to a chair longitudinal direction and being arranged next to said conical receptacle, as seen in the chair longitudinal direction;

at least one spring element interacting with said mechanism upper part and with said base support for returning said mechanism upper part from a pivoted position into a starting position; and said mechanism upper part fastening said rocking mechanism to a seat, a seat support, or frame of the chair, or said rocking mechanism being integrated into the seat, the seat support, or the frame of the chair, with said mechanism upper part being formed by a part of the seat, the seat support, or the chair frame.

In other words, the objects of the invention are achieved in that the chair has a rocking mechanism with a fixed base support formed with a conical receptacle. The base support is placeable by way of the conical receptacle on a chair pillar of the chair. The base support is connected pivotably to a mechanism upper part which forms a housing at least partially enclosing the base support, wherein the pivot axis of the mechanism upper part, which pivot axis runs transversely with respect to the chair longitudinal direction, is arranged next to the conical receptacle, as seen in the chair longitudinal direction, wherein at least one spring element interacting directly or indirectly on the one hand with the mechanism upper part and on the other hand with the base support is provided in order to return the mechanism upper part from a pivoted position into a starting position, and wherein the rocking mechanism is fastened via the mechanism upper part to a seat, seat support or frame of the chair, or the rocking mechanism is integrated into the seat, seat support or frame of the chair, in such a manner that the mechanism upper part is formed by part of the seat, seat support or chair frame.

The overall height of the rocking mechanism is kept low, according to the invention, by the pivot axis of the mechanism upper part being arranged offset in the chair longitudinal direction with respect to the conical receptacle. In comparison to those rocking mechanisms, in which the pivot axis is provided directly over the conical receptacle, this results in a particularly flat design.

Furthermore, the chair is designed in such a manner that the rocking mechanism, which essentially consists only of just a few components arranged on or at a preferably plate-like base support, can be integrated into a construction element of the seat, in particular into the seat itself, the seat support or the frame of the chair. For this purpose, the lower side of the corresponding construction element has a receptacle for the rocking mechanism. In the fitted state, the construction element forms the mechanism upper part of the rocking mechanism. In other words, the rocking mechanism is preferably completely or virtually completely submerged in the chair. Such an integrated design means that the observer does not see the rocking mechanism. Such a rocking mechanism is particularly usable particularly advantageously whenever there is only a very limited construction space.

As an alternative to the integrated solution, the upper part of the rocking mechanism may also be designed as a separate component which is attached to the lower side of the seat, seat support or chair frame. In this case, the rocking mechanism is not embedded into the interior of the chair. However, in comparison to other conventional rocking mechanisms, this alternative is also distinguished by a particularly flat design. There is also a substantial advantage here that the rocking mechanism can be used in the case of installation conditions which are particularly problematic in respect of the available construction space.

Advantageous embodiments of the invention are provided in the dependent claims.

In accordance with an advantageous embodiment of the invention, the seat of the chair is height-adjustable in an infinitely variable manner and, for this purpose, has a blockable lifting apparatus, preferably in the form of a pneumatic spring.

Pneumatic springs of this type comprise a pressure housing and a piston which is axially displaceable in the pressure housing, is held on the end side on a piston rod and divides a housing interior into two working chambers which are filled with a compressed pressure medium and are connected to each other via a valve, wherein the valve has a valve channel which passes through the valve body and is closable by means of a valve pin. The pneumatic spring can be released with the aid of the valve pin, which is guided in a valve pin guide and is arranged in an axially displaceable manner.

It is basically known from the prior art to use pivot levers, which are coupled to the pneumatic spring, in order to actuate the valve pin. The present invention proposes that a pivot lever for actuating the valve pin is designed as a construction element which interacts with at least part of the rocking mechanism. In this case, the axis of rotation of the pivot lever is identical to the pivot axis of the mechanism upper part. The rocking mechanism according to the invention therefore constitutes an extremely compact and therefore space-saving combination component.

In one embodiment of the invention, a common bolt, which is mounted in bearings, serves to pivot the mechanism upper part on the base support. At the same time, the pivot lever is designed in such a manner that it is guided on the bolt and is pivotable about the bolt. For this purpose, the pivot lever advantageously has a receiving sleeve which is arranged on the bolt and is placed between the two bearings, which are provided on the base support, in such a manner that the release of the pivot lever is always located above the valve pin.

In other words, by way of this special construction solution, all of the movement functions, both of the rocking mechanism and of the height adjustment by means of the pneumatic spring, are implemented with the aid of a single axis of rotation. In particular, the pivot lever interacts with at least part of the rocking mechanism in order to actuate the valve pin of the pneumatic spring, wherein, in the configuration described here, the part of the rocking mechanism is the bolt which supports the pivot lever and about which the pivot lever is pivotable.

In accordance with a further preferred embodiment of the invention, a device is additionally provided for blocking the rocking function. The rocking function of the mechanism can therefore be blocked or released. In this connection, it is particularly advantageous for a space-saving and integrated construction if a common actuating device is provided, said actuating device being usable both for the height adjustment of the chair and for the blocking and releasing of the rocking function of the mechanism.

In spite of the compact design, an individual setting capability of the mechanism must not be dispensed with. Thus, in a further preferred embodiment of the invention, a device for setting the pretensioning of the at least one spring element is provided, and therefore the pivoting resistance of the rocking mechanism can be set individually to a user.

In comparison to other solutions with a plurality of axes of rotation spaced apart from one another in the chair longitudinal direction, significantly smaller construction space is required as a result with the solution according to the invention. Despite the incorporation of the height adjustment function, the rocking mechanism can be designed to be particularly flat and small.

The proposed rocking mechanisms are of particularly simple construction structurally. Complicated lever constructions or the like are not required. This not only reduces the structural outlay, and therefore at the same time also the risk of malfunctions and failures. The solution according to the invention may also be used in conjunction with all conventional types of pneumatic springs. An advantage in this case is also the space in the release device for the pneumatic spring, said space being significantly reduced in comparison to conventional solutions.

Other features which are considered as characteristic for the invention are set forth in the appended claims.

Although the invention is illustrated and described herein as embodied in a chair with a rocking mechanism, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
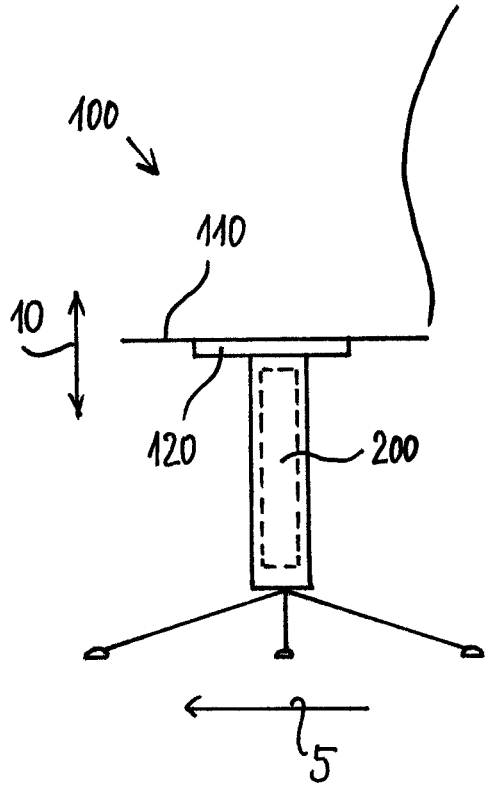
FIG. 1 shows a chair with a rocking mechanism and a blockable lifting device.

The figures of the drawing show the invention merely schematically and with the primarily important parts thereof. The same reference numbers correspond in this case to elements of identical or comparable function.

Referring now to the figures of the drawing in detail and first, particularly, to FIG. 1 thereof, there is shown a conference chair 100 with a blockable lifting device in the form of a pneumatic spring 200. The pneumatic spring 200 is located in the interior of the chair pillar 1. The seat surface 110 of the conference chair 100 is height adjustable in the infinitely variable manner (arrow 10) with the aid of the pneumatic spring 200.

Figure 2:
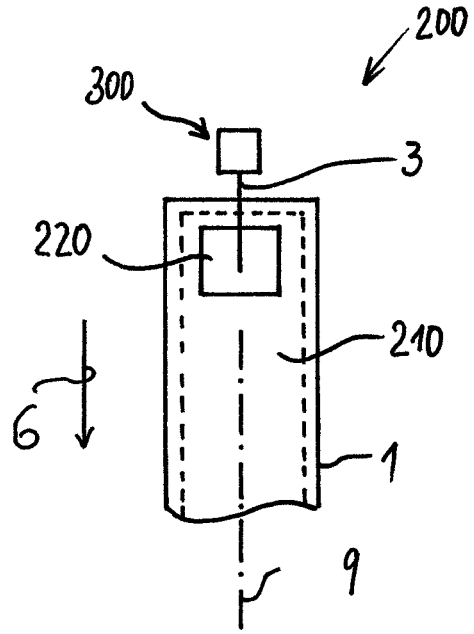
FIG. 2 shows a blockable lifting device with a release device in detail.
Figure 3:
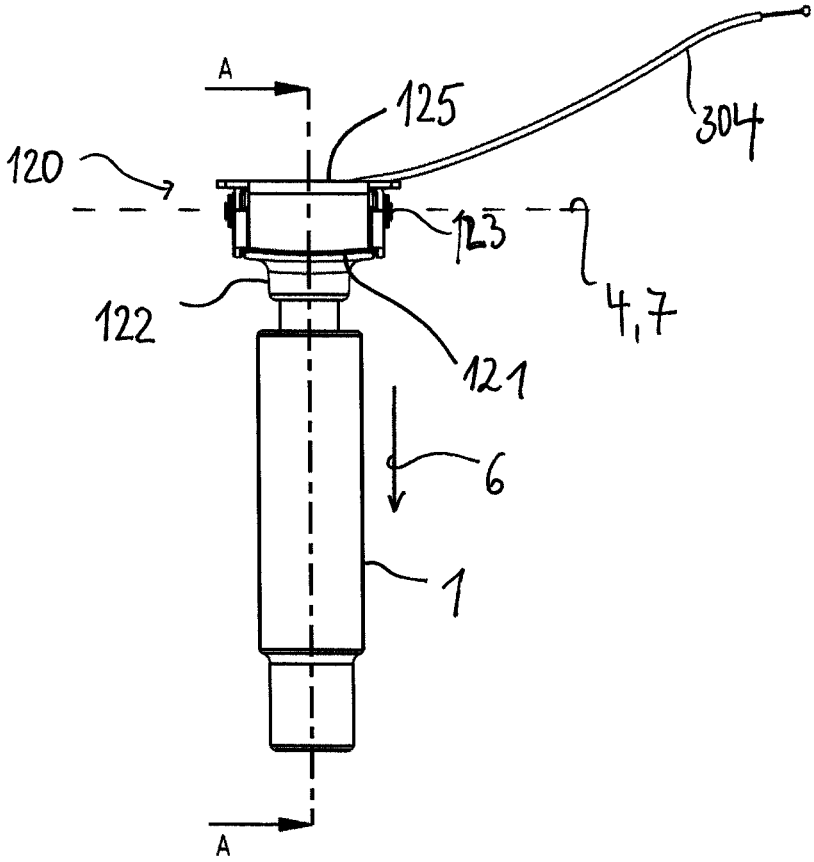
FIG. 3 is a side view of a pneumatic spring and a rocking mechanism.

As FIG. 2 shows, the pneumatic spring 200 comprises, in the customary manner known to those of skill in the art, a pressure housing 210 and a blocking device in the form of a blocking valve 220 for fixing a desired lifting height. An actuating element which is arranged in a valve pin guide, is sealed in the valve pin guide by a corresponding valve pin seal and is in the form of a valve pin 3 serves to actuate the blocking valve 220 and therefore to release the pneumatic spring 200. The release device 300 according to the invention serves to actuate the valve pin 3. A rocking mechanism 120 in the substructure of the chair permits the seat and backrest to pivot rearwards.

Rocking mechanisms 120 according to the invention are depicted in detail FIGS. 3 to 8. As far as the actual kinematics are concerned, the rocking mechanisms 120 are of mirror-symmetrical construction with respect to the center longitudinal plane thereof, compare FIGS. 6 and 8. In this respect, the description below should always be based on construction elements of the rocking mechanisms 120, the construction elements being present in pairs on both sides.

The rocking mechanisms 120 illustrated in FIGS. 3 to 8 have a base support 121 which is placed onto the upper end 2 of the chair pillar 1 by means of a conical receptacle 122. The movable base support 121 is constructed substantially in a plate-like manner and is partially enclosed by a mechanism upper part.

Figure 7:
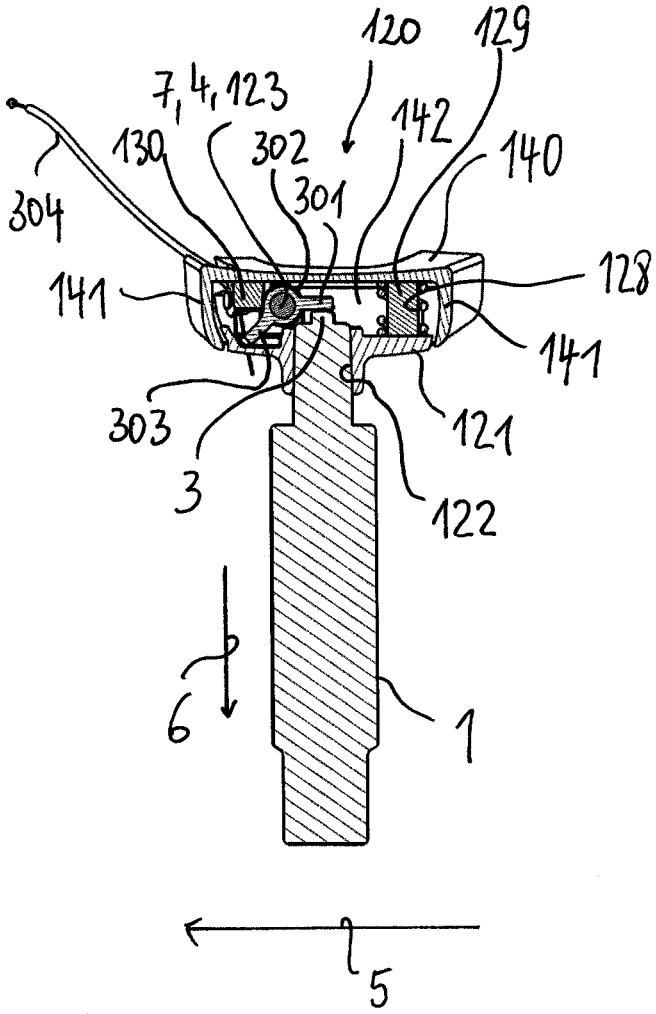
FIG. 7 shows a sectional illustration corresponding to FIG. 4, taken along the line A-A in FIG. 3, with a chair frame forming the mechanism upper part.
Figure 8:
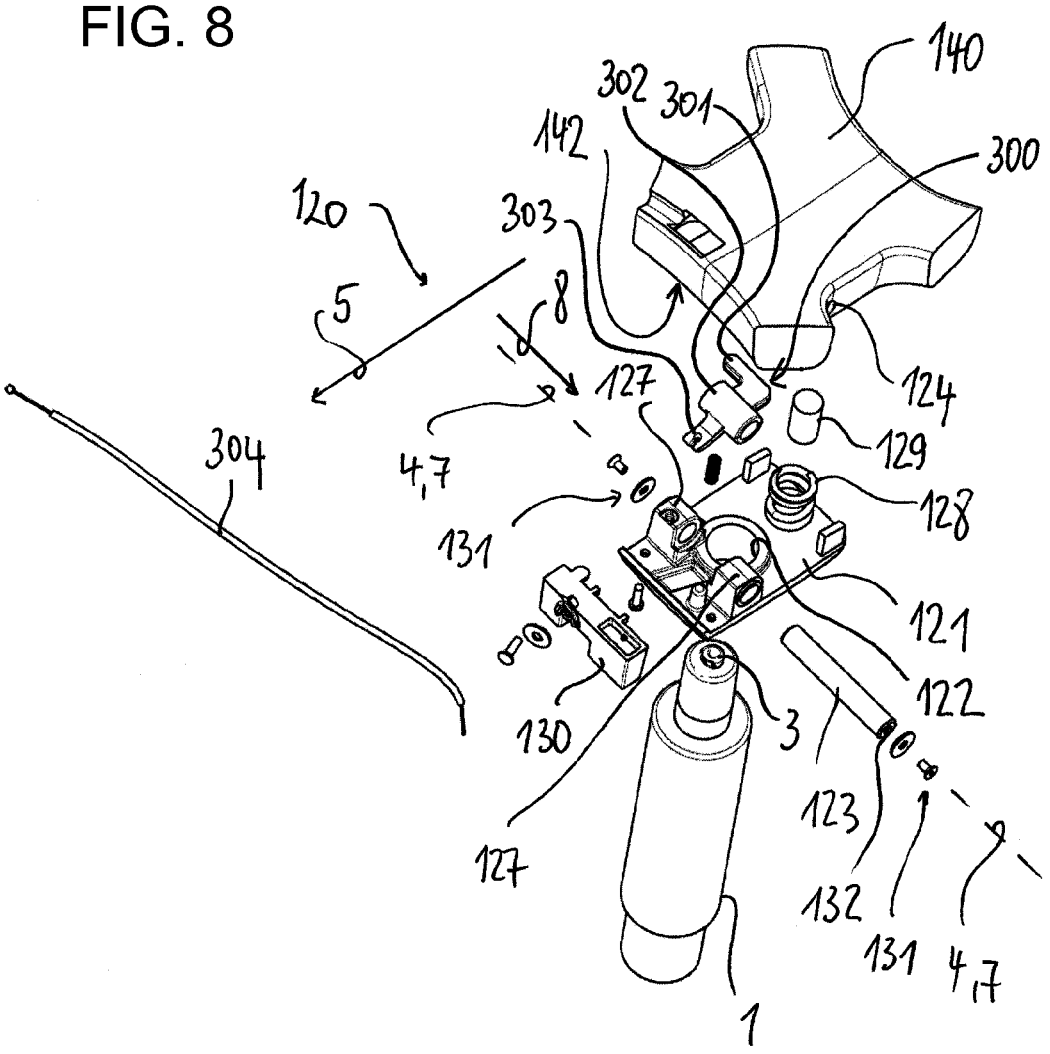
FIG. 8 is an exploded view of the construction elements depicted in FIG. 7.

The mechanism upper part is either designed, as illustrated in FIGS. 3 to 6, as a separate component 125 which can be attached with the aid of fastening means to the lower side of a chair frame, a seat support or a seat 110 of the conference chair 1. As an alternative thereto, the mechanism upper part, as depicted in FIGS. 7 and 8, is formed by one of the above-mentioned construction elements of the chair 100, i.e. a frame, a seat support or a seat, and therefore, in the fitted state, the elements of the rocking mechanism 120 are embedded into the relevant chair element. In the example illustrated in FIGS. 7 and 8, part of the frame 140 forms the mechanism upper part. For this purpose, the frame 140 has a receiving opening 142 designed for receiving the rocking mechanism 120.

The side walls 126 of the upper part 125 and the inner walls 141 of the receiving opening 142 in the frame 140 reach beyond the borders of the base support 121 in the non-pivoted starting position, in as many intermediate positions as possible and advantageously also in a position pivoted to maximum extent to the rear, and therefore the interior of the mechanism housing formed in this manner is not accessible from the outside and therefore is also protected from soiling. At the same time, inadvertent engaging of a seat user in the mechanism 120 is prevented as a result.

Figure 4:
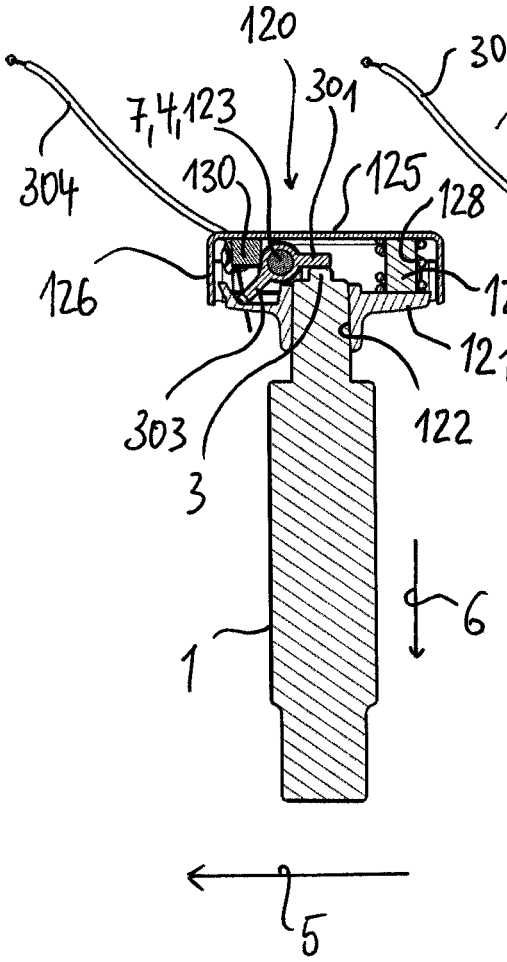
FIG. 4 shows a section through the construction element illustrated in FIG. 3, along the line A-A, in a starting position.
Figure 5:
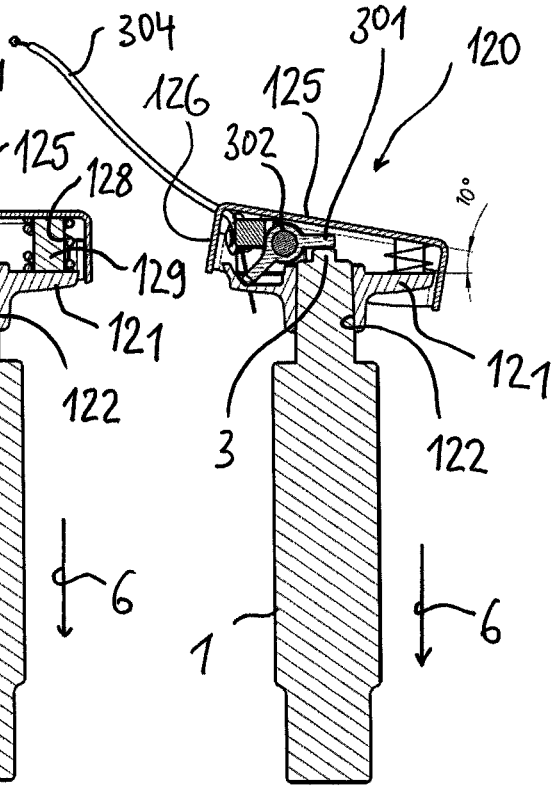
FIG. 5 shows a section through the construction elements illustrated in FIG. 3, along the line A-A, in a backrest position pivoted rearwards.
Figure 6:
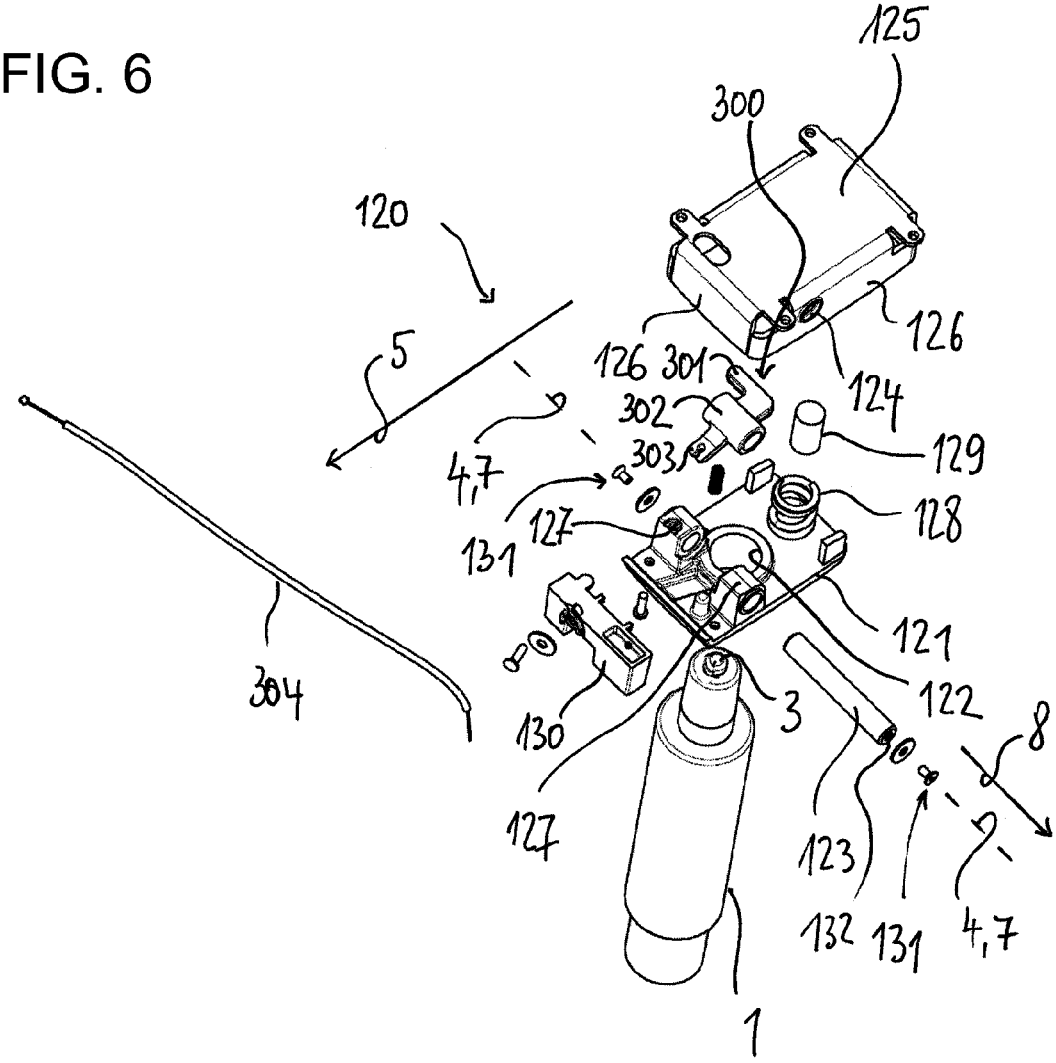
FIG. 6 is an exploded view showing the construction element shown in FIG. 3.

The mechanism upper part 125, 140 is connected at the rear end thereof directly or indirectly to a backrest support (not depicted). It is connected pivotably to the base support 120 such that the entire seat together with the backrest can be pivoted rearwards relative to the base support 121, which is mounted fixedly on the chair pillar 1. FIGS. 4 and 7 show a starting position, in which the seat or seat support takes up a substantially horizontal position. FIG. 5 shows the rocking mechanism 120 in a position pivoted rearwards.

The position of the pivot axis 4 of the mechanism upper part 125, 140 is defined by a bolt 123 connected fixedly to the mechanism upper part. For this purpose, the upper part has, on both sides, bores 124 for receiving the bolt 123. The bolt 123 is fixed on the upper part 125, 140 by screws 131 which, upon installation, engage in threaded bores 132 in the end sides of the bolt 123. The bolt 123 is mounted on two bearings 127 provided on the base support 121. The bearings 127 are arranged offset with respect to the conical receptacle 122 in such a manner that the pivot axis 4 of the mechanism upper part 125, 140, which pivot axis runs transversely with respect to the chair longitudinal direction 5 (i.e., the forward and backward looking direction of the chair, in normal usage), is arranged next to the conical receptacle 122, namely in front of the conical receptacle 122, as seen in the chair longitudinal direction 5.

For the definition of a desired pivoting resistance of the backrest of the conference chair 100, a number of spring elements is customarily provided, wherein, for example, tension or compression springs may be involved. In the embodiment described here, an individual central compression spring 128 is provided, the compression spring being supported by one spring end thereof on the base support 121 and by the opposite spring end thereof on the inside of the mechanism upper part 125, 140. An elastomer cylinder 129 is optionally inserted in the interior of the compression spring 128, said elastomer cylinder, as a means of protecting against buckling, preventing the compression spring 128 from buckling when being compressed. At the same time, the elastomer cylinder 129 acts as an additional spring element and supports the function of the compression spring 128. During pivoting of the combination of seat support and backrest support, the compression spring 128, is compressed. In other words, the user has to pivot the backrest counter to the spring force. The spring elements 128, 129 serve subsequently to return the mechanism upper part 125, 140 from the pivoted position into the starting position. Instead of the single compression spring 128, use may also be made of a plurality of compression springs, for example arranged next to one another, or else also of other spring elements. The compression spring 128 or the spring elements used are preferably arranged on that side of the conical receptacle 122 which is opposite the pivot axis 4 and the bolt 123. The mechanism housing interior, which is formed by the mechanism upper part 125, 140, is therefore made optimum use of. In an alternative variant embodiment, the at least one spring element, for example in the form of a tension spring, may also be arranged, however, on that side of the conical receptacle 122 on which the bolt 123 is already provided.

In order to adjust the height of the seat 110, a pneumatic spring 200 is provided in the chair pillar 1. The valve pin 3 of the pneumatic spring 200 is arranged parallel to the longitudinal axis 9 of the pneumatic spring 200 and protrudes by one end thereof out of the upper side 2 of the chair pillar 1. In order to displace the valve pin 3 in the release direction 6, here downward into the chair pillar 1, the release 301 of a pivot lever 300 serving as the release device is positioned above the valve pin 3. The release 301, in the starting position thereof, bears on the end side of the valve pin 3.

The pivot lever 300 interacts with the rocking mechanism 120. For this purpose, said pivot lever is placed in such a manner that the axis of rotation 7 of the pivot lever 300 coincides with the pivot axis 4 of the mechanism upper part 125, 140. For this purpose, the pivot lever 300 is arranged pivotably on the bolt 123 by having a receiving sleeve 302 for the bolt 123, said receiving sleeve being arranged between the two bearings 127. In this case, the receiving sleeve 302 is adjacent on both sides to the bearings 127 and is thereby fixed in position, i.e. can only move insignificantly, if at all, in the bolt longitudinal direction 8. By this means, the release 301 of the pivot lever 300, which release is arranged on the receiving sleeve 302, is located directly above the valve pin 3 of the pneumatic spring 200. The bolt 123 performs the function of a space-saving combination component by, firstly, permitting pivoting of the pivot lever 300 independently of a pivoting of the mechanism upper part 125, 140 and therefore permitting actuation of the pneumatic spring 200 and, secondly, ensuring pivoting of the mechanism upper part 125, 140 independently of a pivoting of the pivot lever 300, and therefore ensuring the operation of the rocking mechanism.

The pivot lever 300 may be actuated directly, for example, manually, or else with an aid, for example a pulling means, such as a Bowden cable or the like. The use of a pulling means has the advantage that a suitable actuating means for the pulling means can be fastened to the chair 100 at any suitable location. Since the actuating means can be fitted away from the pneumatic spring 200, the space required at the installation location of the release device 300 is reduced.

In the present case, a Bowden cable 304 is used in order to actuate the pivot lever 300. As actuating means for the Bowden cable 304, use is made of, for example, a key button (not depicted) which is connected to the Bowden cable 304, is arranged away from the chair pillar 1 and is pivotable at a positionally fixed axis.

The Bowden cable 304 is connected via a fastening nipple (not depicted) to a lever arm 303 which is fitted on that side of the receiving sleeve 302 which is opposite the release 301. For this propose, the lever arm 303 is of slotted design, and the Bowden cable 304 is hooked with the fastening nipple thereof into the slot. A function block 130 which is arranged parallel to the pivot axis 4 in the interior of the mechanism housing serves as a counterbearing for the Bowden cable 304, in particular for supporting the Bowden cable sheath. The function block 130 has a receptacle or bushing in which the Bowden cable 304 is guided and the Bowden cable sheath is fixed with the aid of fastening means.

Actuation of the Bowden cable 304 causes the lever arm 303 to rise and therefore, because of the pivoting of the receiving sleeve 302 about the axis of rotation 7, at the same time causes the release 301 to be pressed down, thus moving the valve pin 3 in the release direction 6. The blocking valve 220 is therefore opened, as a result of which the pneumatic spring 200 is released and the chair 100 can be adjusted in height. The arrangement of the lever arm 303 relative to the release 301 is variable. In particular, the lever arm 303 does not have to be arranged absolutely exactly opposite the release 301. By means of the use of the Bowden cable 304, even in different configurations than the configuration shown here, the release force introduced via the receiving sleeve 302 is deflected into a pivoting movement of the release 301, said pivoting movement ultimately resulting in an axial movement of the valve pin 3.

The bearings 127 for receiving the bolt 123 are placed in such a manner and/or the pivot lever 300 fitted on the bolt 123 is designed in such a manner that, when the Bowden cable 304 is not actuated, the release 301 lies substantially horizontally on the valve pin 3.

Irrespective of the previously described exemplary embodiment, the invention may also be made possible in a modified manner. For example, the valve pin 3 does not have to project out of the upper side 2 of the chair pillar 1. The pivot lever 300 may also be designed and positioned in such a manner that, when the pulling means 304 is actuated in order to actuate the valve pin 3, the release 301 reaches into the interior of the chair pillar 1.

Also, the pneumatic spring 200 does not have to be released by a movement from the top downward. A movement of the valve pin 3 from the bottom upward is also conceivable. Furthermore, an embodiment is also possible in which the pneumatic spring 200 is not installed vertically. Also, the valve pin 3 does not have to run or be movable parallel to the longitudinal axis 9 of the pneumatic spring 200.

Irrespective of the pivoted positions of the backrest and seat support that are illustrated in FIGS. 4 and 5 and 7, respectively, height adjustment with the aid of the pneumatic spring 200 can take place at any time with the aid of the Bowden cable 304. The pneumatic spring 200 can be released not only in the starting position but also in any random rearwardly pivotable position of the mechanism upper part 125, 140 and therefore of the seat.

Figure 9A:
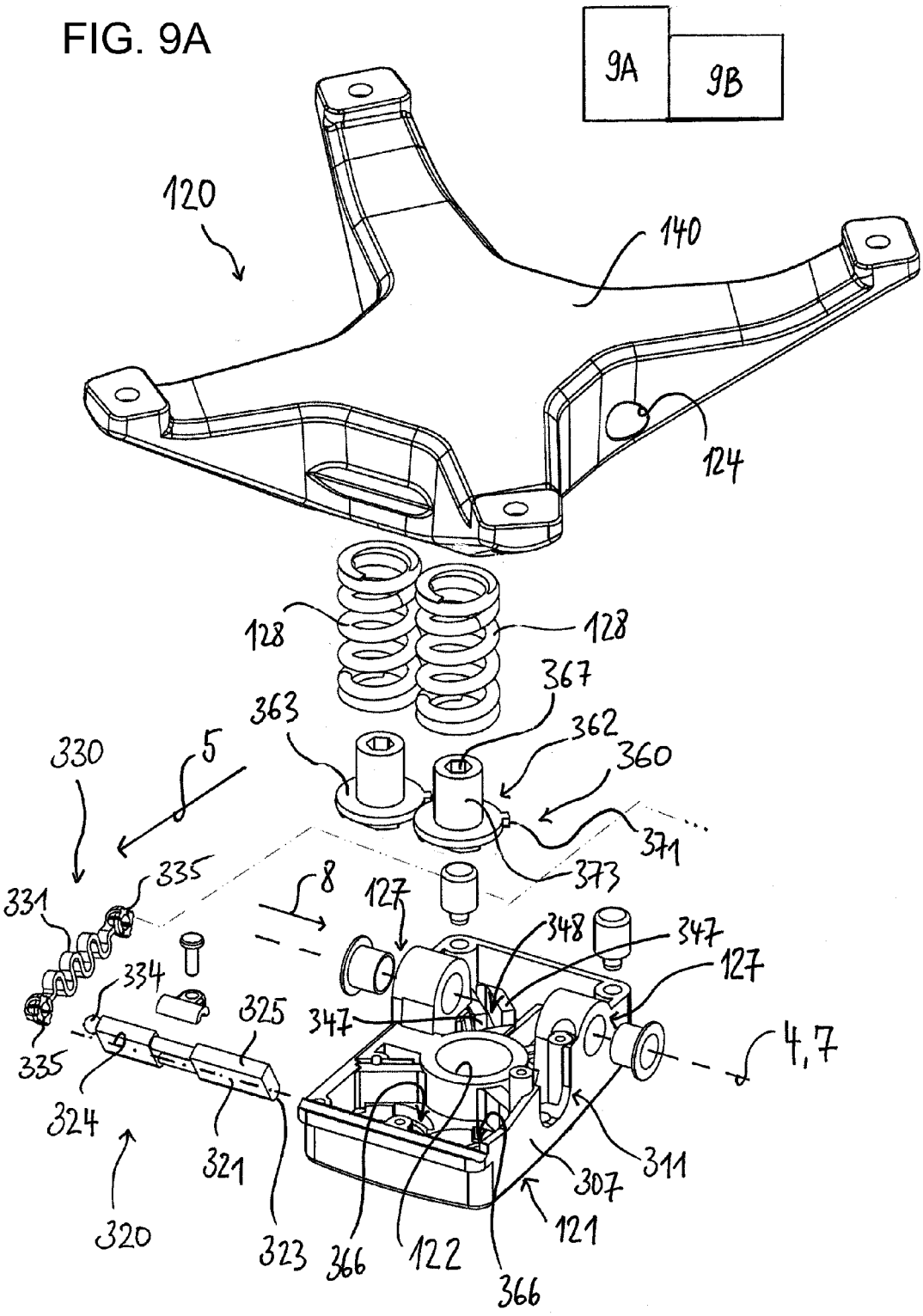
FIG. 9 is an exploded view of the construction elements of a rocking mechanism with a blocking device.
Figure 9B:
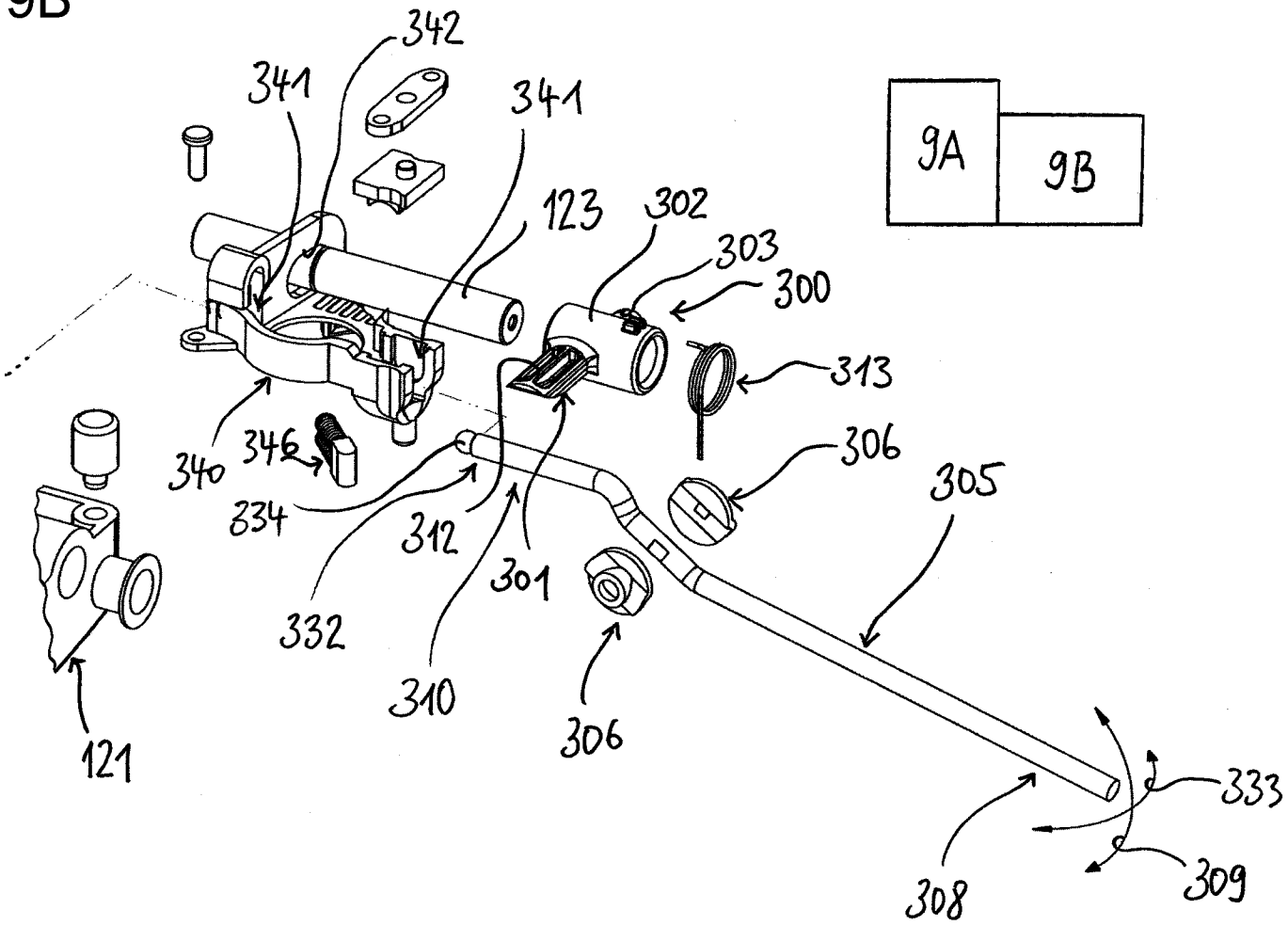
Figure 10:
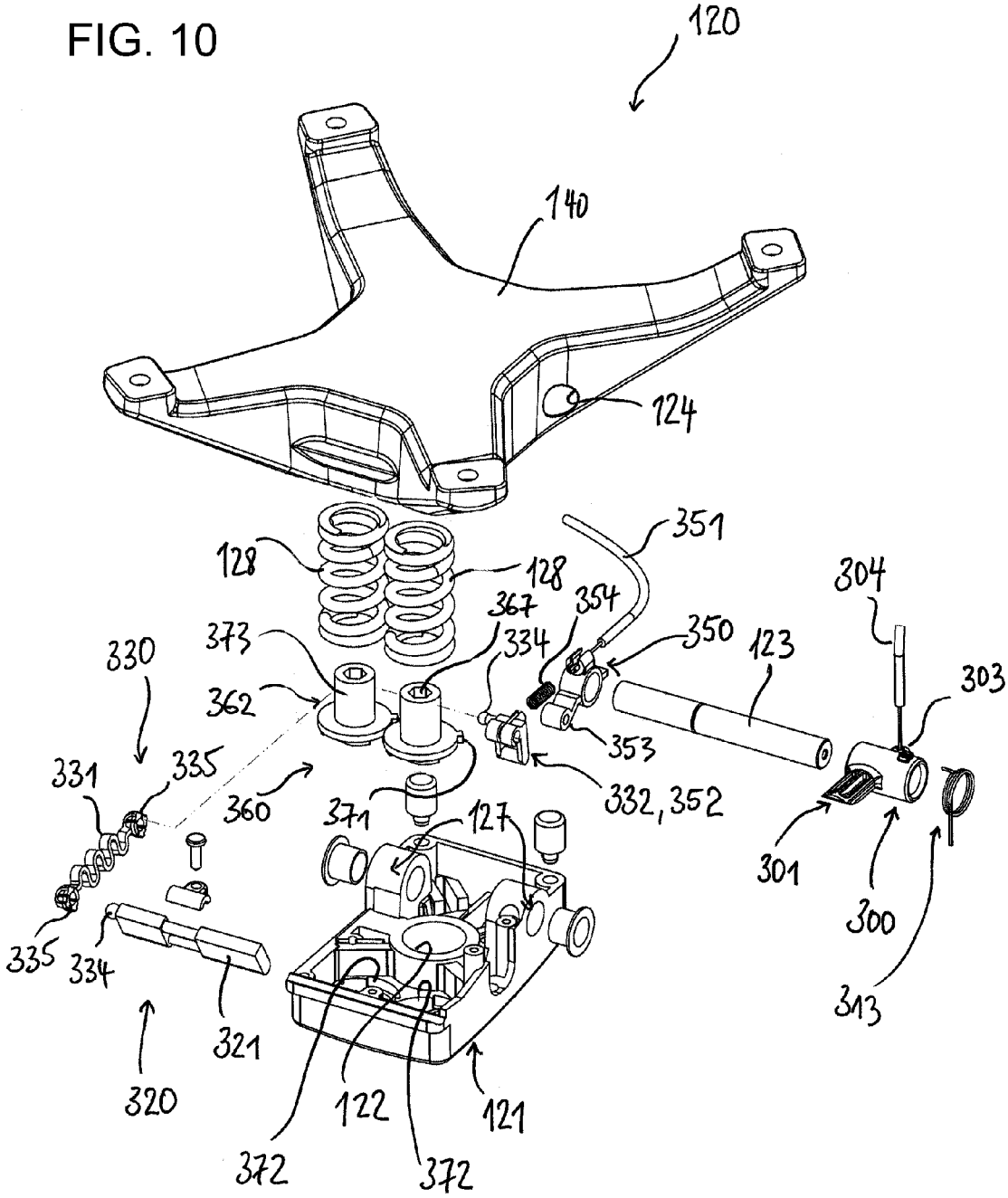
FIG. 10 is an exploded view of the construction elements of a further rocking mechanism with a blocking device.
Figure 11:
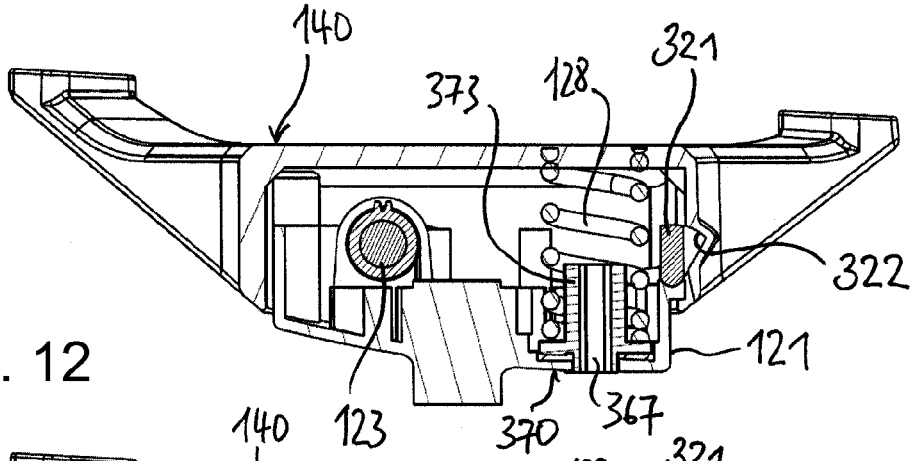
FIG. 11 is a sectional illustration of the rocking mechanism depicted in FIG. 10, with the rocking function released.
Figure 12:
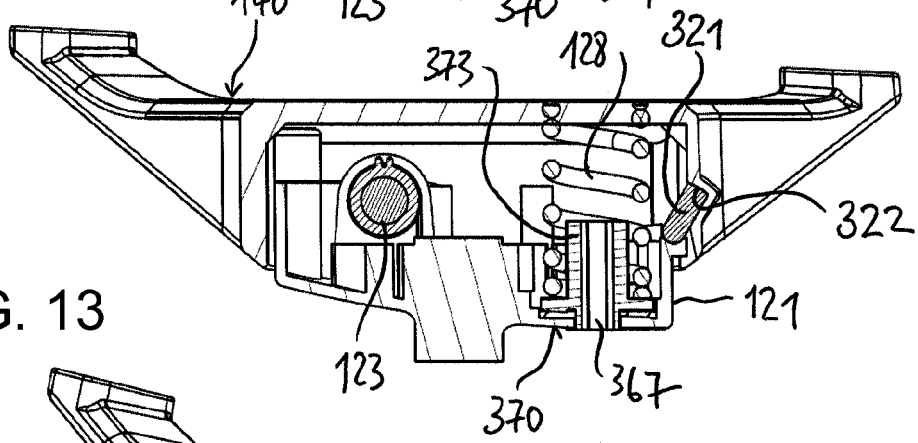
FIG. 12 is a sectional illustration of the rocking mechanism depicted in FIG. 10, with the rocking function blocked.
Figure 13:
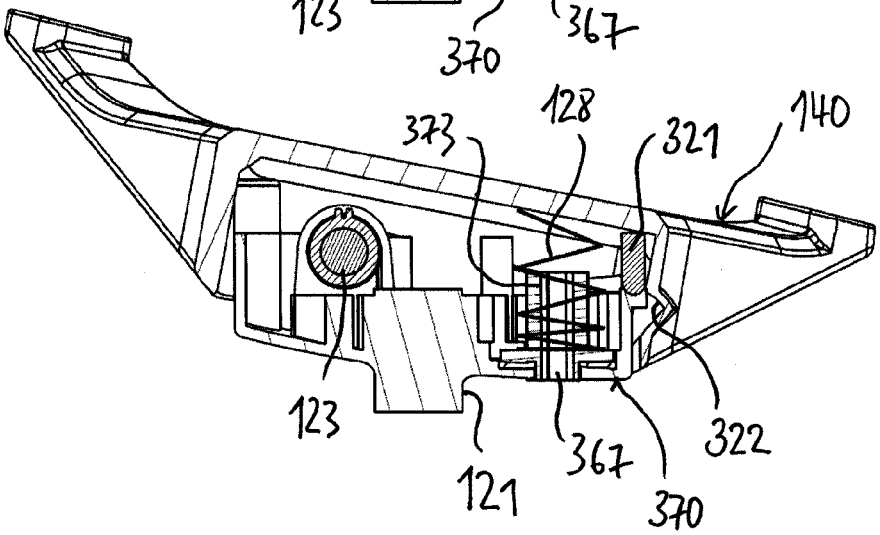
FIG. 13 is a sectional illustration of the rocking mechanism depicted in FIG. 10, with the rocking function released, in a position pivoted rearwards.
Figure 14:
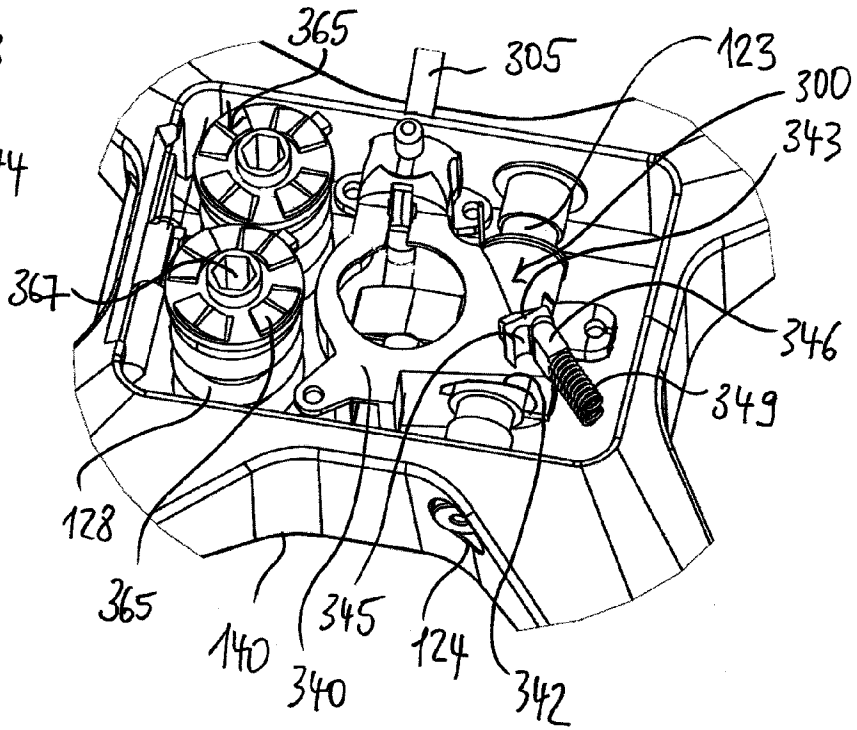
FIG. 14 is a perspective view from below showing a construction element, which is arranged in a mechanism upper part, of the rocking mechanism illustrated in FIG. 9, without the base support and with the rocking function blocked.
Figure 15:
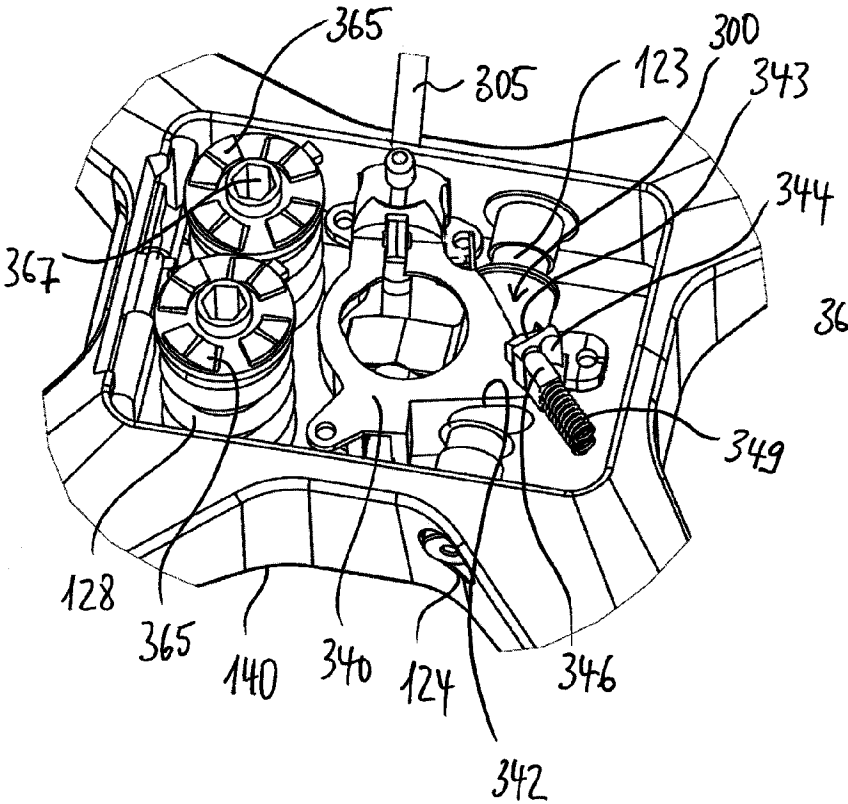
FIG. 15 is a perspective view from below showing a construction element, which is arranged in a mechanism upper part, of the rocking mechanism illustrated in FIG. 9, without the base support and with the rocking function released.

A further rocking mechanism according to the invention has, as depicted in FIGS. 9, 14 and 15, a different aid for actuating the pivot lever 300. Instead of a Bowden cable, an actuating lever 305 is used to operate the height adjustment. The actuating lever is mounted on the base support 121, here in a side wall 307 of the base support 121, with the aid of a bearing 311 formed by bearing elements 306.

In the variant embodiment illustrated in FIG. 9, the actuating lever 305 lies on the upper side 312 of the release 301 and therefore acts directly on the release 301. In order to activate the height adjustment, the free end 308 of the actuating lever 305, which free end serves as a handle and is optionally provided with a hand grip (not illustrated), is moved vertically, i.e. upward or downward, see arrows 309. In the example illustrated in FIG. 9, during a movement of the free end 308 upward, the lever end 310 of the actuating lever 305 moves downward and therefore presses the release 301 down, as a result of which the blocking valve 220 is opened and a height adjustment of the chair 100 is possible. A torsion spring 313 which is attached to the receiving sleeve 302 and therefore acts on the receiving sleeve 302 ensures that the pivot lever 300 moves back again into the starting position thereof after the actuation of the blocking valve 220.

In another variant embodiment (not depicted), the actuating lever 305 does not act on the release 301, but rather on the lower side of the opposite lever arm 303 of the pivot lever 300. In this case, by means of a movement of the free end 308 upward, the lever arm 303 is carried along upward and therefore the release 301 is pressed down.

In a further rocking mechanism according to the invention, a device 320 is provided for blocking and releasing the rocking function of the rocking mechanism 120. In the variant embodiments described by way of example here, this firstly concerns the rocking mechanism which is depicted in FIGS. 9, 14 and 15, and also the rocking mechanism which is depicted in FIGS. 10 to 13. The blocking device 320 preferably functions independently of the height adjustment and is preferably operable independently of the height adjustment.

The blocking device 320 comprises a block wedge 321 which is fastened pivotably to the base support 121 and can be transferred from a normal position into a blocking position and back again. In the blocking position, see FIG. 12, rocking, i.e. pivoting of the upper part 125, 140 rearwards, is no longer possible, since the blocking wedge 321 takes up a pivoted position in relation to the normal position and in which said blocking wedge engages in a corresponding blocking groove 322 provided on the upper part 125, 140.

Engagement of the blocking wedge 321 in the blocking groove 322 is possible exclusively in the zero position of the seat, in which the latter is not pivoted rearward. In other words, the blocking device 320 does not serve for fixing a certain pivoted position of seat and backrests, but rather merely for arresting the seat in the zero position.

In the fitted state, the substantially cuboidal blocking wedge 321 rests with the lower edge 323 thereof on the base support 121 and is pivotable about a pivot axis 324 running in the vicinity of the lower edge 323 thereof in the longitudinal direction of the wedge. In the blocking position, the upper edge 325 of the blocking wedge 321 engages in the blocking groove 322. Since the blocking wedge 321 extends substantially over the entire width of the base support 121, reliable blocking of the rocking function is achieved.

The blocking device 320 is operated with the aid of an actuating device 330. Said actuating device 330 comprises a transmission element 331 which acts directly on the blocking wedge 321 and is designed for transmitting an adjusting movement from an actuating element 332, which is, for example, manually actuable, to the blocking wedge 321.

In the examples described here, the transmission element 331 is designed as a partially elastic spring element. By means of storage of deformation energy in the transmission element 331, a rapid pivoting operation of the blocking wedge 321 is reliably ensured as soon as the actuating element 332 has covered a defined minimum distance.

If the rocking mechanism 120 is a mechanism in which an actuating lever 305 is provided for actuating the pivot lever 300, as illustrated in FIGS. 9, 14 and 15, the actuating lever 305 is advantageously designed at the same time as the actuating element 332 of the actuating device 330 for the blocking device 320.

In this case, the transmission element 331 is attached pivotably with the aid of coupling pieces 335 provided on the end sides firstly to a coupling piece 334 of the blocking wedge 321, which coupling piece is fastened in the vicinity of the upper edge 325 of the blocking wedge 321, and secondly to an identical coupling piece 334 which is fastened to the end of the lever end 310. In this case, the coupling pieces 334 are partially spherical or dome-shaped, and the coupling pieces 335 are designed as receiving shells for receiving the coupling pieces 334, thus resulting in a flexible connection in the manner of a ball and socket joint.

In the variant embodiment depicted in FIG. 9, the free end 308 of the actuating lever 305 can be moved not only vertically but, in order to actuate the blocking device 320, also horizontally, i.e. to the right or left, see arrows 333. In this case, the correspondingly arising movement of the lever end 310 causes blocking or release of the rocking function.

In other words, given a corresponding movement, the actuating lever 305 also acts via the transmission element 331 on the blocking wedge 321. For this purpose, in the embodiment shown here, the actuating lever 305 acts with the lever end 310 thereof directly on the transmission element 331. By movement of the free end 308 of the actuating lever 305 to the right or left, the transmission element 331 is acted upon and therefore the blocking wedge 321 is pivoted, which results in blocking or release of the rocking function.

Furthermore, the transmission element 331, which is designed as a partially elastic spring element, provides protection against damage to the construction elements involved. If a user, for example, attempts to move the blocking wedge 321 with the aid of the actuating lever 305 when the seat is not in the zero position but rather is in a rearwardly pivoted position, the transmission element 331 yields, and therefore the construction elements concerned, for example the blocking wedge 321, are not damaged.

It is particularly advantageous if, in addition, a securing means for securing the blocked or unblocked state of the rocking mechanism 120 is provided. Said securing means is intended, firstly, to prevent undefined intermediate positions, i.e. in other words, to ensure that the rocking mechanism 120 is either reliably blocked or else is reliably released. Secondly, the securing means is intended to ensure that the blocking device 320 is not inadvertently actuated. Finally, the securing means is intended also to provide the user with feedback regarding the successful completion of a setting operation. This is achieved in that the lever end 310 of the actuating lever 305 lies in the receptacle 341 of a driver 340. The driver 340 is mounted on the base support 121 and is supported on the bolt 123 by means of an elongated hole 342. Upon movement of the actuating lever 305, the driver 340 is at the same time moved essentially transversely with respect to the pivot axis 4. By this means, a latching recess 343 fastened on the driver 340 is moved relative to the base support 121.

The latching recess 343 has two latching steps 344, 345 which are directly adjacent to each other, wherein one latching step 344 is assigned to the blocking position of the blocking wedge 321, and therefore to the blocked state of the rocking mechanism 120 (FIG. 14), and the other latching step 345 is assigned to the normal position of the blocking wedge 321, and therefore to the unblocked, released state of the rocking mechanism 120 (FIG. 15).

The latching recess 343 interacts with a latching element 346 in such a manner that, depending on the state of the rocking mechanism 120, the latching element 346 lies either in the one or the other latching step 344, 345 of the latching recess 343. The latching steps 344, 345 are formed concavely. The latching element is formed convexly in a manner corresponding to the shape of the latching steps 344, 345. The latching steps 344, 345 are separated from each other by a partition which is designed in such a manner that it can be overcome by the latching element 346, thus enabling a direct change from the one to the other latching step 344, 345.

The latching element 346 is connected to the base support 121. In more precise terms, the latching element 346 lies in a receiving pocket 348 which is formed by two delimiting ribs 347 in the base support 121. The latching element is pressed against the latching recess 343 with the aid of a spring element 349 likewise lying in the receiving pocket 348. The spring element 349 therefore ensures reliable latching.

Despite only a single combined actuating element 305 being provided, activation of the height adjustment by actuation of the blocking valve 220 is also possible according to the invention whenever the rocking function is blocked. For this purpose, the pivot lever 300 and actuating lever 305 are dimensioned and coordinated with each other in such a manner that the lever end 310 of the actuating lever 305 acts on the pivot lever 300 irrespective of the blocking or release position of the actuating lever 305.

If the rocking mechanism 120 is a mechanism in which a Bowden cable 304 is provided in order to actuate the pivot lever 300, see FIGS. 10 to 13, then a pivot element 352 which is actuable by a second Bowden cable 351 then serves as an actuating element 332 for actuating the blocking device 320. The pivot element 351, which is pivotable by the second Bowden cable 351, then acts instead of the actuating lever 305 on the transmission element 331. For this purpose, a function block 350, which is designed in the form of a receiving sleeve, is arranged adjacent to the pivot lever 300 on the bolt 123 and therefore in a fixed position with respect to the base support 121. Said function block 350 has a receptacle or bushing in which the second Bowden cable 351 is guided. The function block 350 serves as a counterbearing for the second Bowden cable 351. The Bowden cable sheath is fixed therein with the aid of fastening means. The Bowden cable end is held in the pivot element 352. At the same time, the pivot element 352 which is connected to the end of the second Bowden cable 351 is connected to the function block 350 in a spring-loaded manner. For this purpose, a limb 353 of the function block 350 lies in a receiving opening which is formed by four frame elements and is provided on the pivot element 352. The limb 353 is provided with a receiving bore through which a pivot bolt (not illustrated) is inserted, said pivot bolt being mounted at the ends thereof in bearing openings (not depicted). The bearing openings are located in those frame elements which, in the fitted state, are located directly in front of the openings in the receiving bore.

By actuation of the second Bowden cable 351, the pivot element 352 is pivoted counter to the force of a spring element 354 fitted between the function block 350 and pivot element 352. This results in pivoting of the blocking wedge 321, which, in turn, results in blocking or release of the rocking function.

In the variant embodiment illustrated here, the function block 350 is fastened to the bolt 123. This makes optimum use of the construction space, which is present in the base support 121, between the bearings 127. At the same time, such an arrangement facilitates the installation of the function block in the same manner as the arrangement of the remaining construction element on the bolt facilitates the installation thereof during the production of the rocking mechanism 120. All that is required is to plug the structural elements onto the bolt 123. A complicated screw connection or the like is not necessary. In another embodiment of the invention, the function block 350 could also be provided at a different location, for example as part of the base support 121.

The mechanisms illustrated in FIGS. 9 to 15 also differ from the mechanisms illustrated in FIGS. 3 to 8 in that, instead of a central compression spring 128, said mechanisms have two compression springs 128 arranged next to each other and acting in parallel. In a preferred variant embodiment, provision is made for the spring elements 128 and the construction elements interacting with the spring elements 128 to be designed in such a manner that the prestressing of the spring elements 128 can be set with the aid of a spring adjustment device 360. By this means, the pivoting resistance of the rocking mechanism 120 can be set.

The compression springs 128 are in turn supported by the spring ends thereof at one end on the inside of the mechanism upper part 125, 140 and at the other end on the base support 121. However, the spring ends 361 supported on the base support 121 now rest on spring plates 362. On the lower sides 364 thereof opposite the spring bearing surfaces 363, the spring plates 362 have wedge-shaped sliding bodies 365. Said sliding bodies 365 interact with sliding bodies 366 provided on the base support 121 and are supported on said sliding bodies. Said sliding bodies 366 are likewise of wedge-shaped design, but arranged in an opposed manner. The sliding bodies 366 are arranged in circular spring plate receptacles 372 in the base support 121.

The two pairs of sliding bodies 365, 366 together with the spring plates 362 form the essential parts of the spring adjustment device 360.

The spring plates 362 are formed with central operating openings 367 designed in the example as hexagonal openings. The operating openings 367 also extend through the anti-buckling cylinders 373 of the spring plates 362, which anti-buckling cylinders adjoin the spring bearing surfaces 363. The spring plates 362 are rotatable with the aid of a suitable tool via said operating openings 367 about an adjustment axis 369 running perpendicularly to the spring bearing surfaces 363 and parallel to the spring longitudinal axes.

Figure 16:
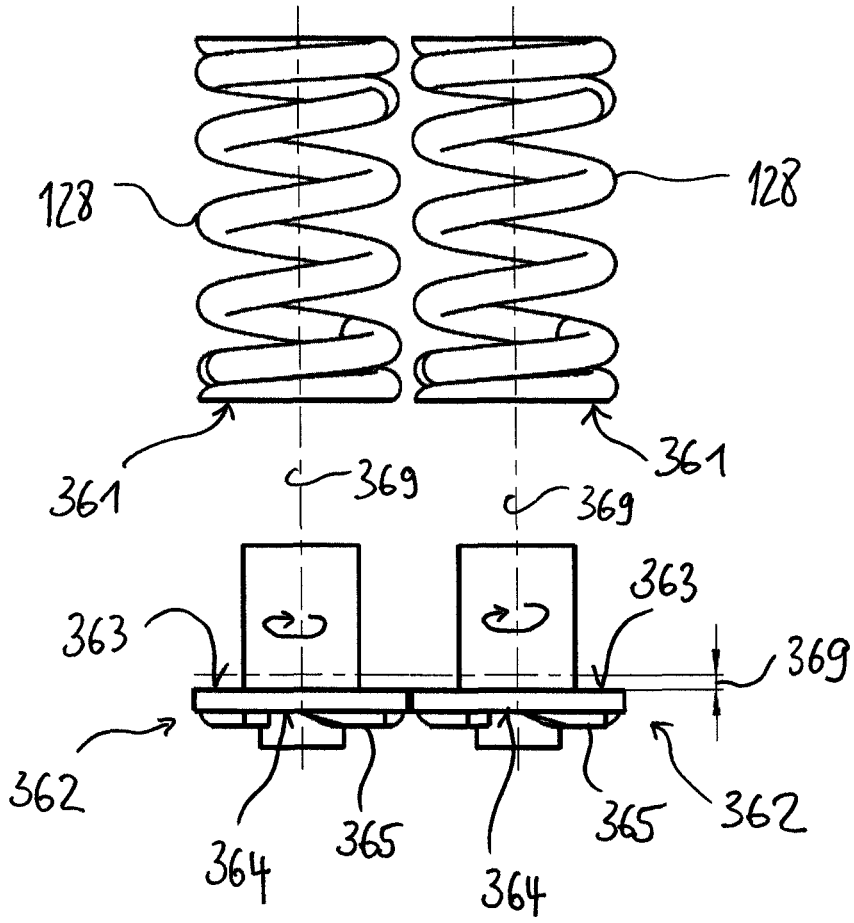
FIG. 16 shows a side view of the spring elements and spring plates from the mechanisms depicted in FIGS. 9 to 13.

When the spring plates 362 are rotated, said spring plates are supported on the base support 121 and are screwed vertically. In the process, for example, a rotation of the spring plates 362 through 60° causes the spring bearing surfaces 363 to rise by a rising distance 369 of a few millimeters, see FIG. 16. Following presetting of the pivoting resistance at the factory, said pivoting resistance can be finely adjusted by the purchaser of the chair 100. The mechanism does not need to be opened for this purpose, since the hexagonal openings 367 on the lower side 370 of the base support 121 are freely accessible.

The wedge-shaped sliding bodies 365, 366 on the spring plates 362 and base support 121 are preferably designed and arranged in such a manner that each spring plate 362 is located either in a defined lower or a defined upper position. In the example illustrated, positions of the spring plates 362 going beyond said end positions are prevented by stops 371 which are fitted on the spring plates 362 and interact with the base support 121, and which therefore simultaneously delimit the permissible rotation range of the spring plates 362. Since there are two compression springs 128 overall and preferably two positions of the spring plates 362 are possible with each compression spring 128, the at least four different defined pivoting resistances can be set as a result for the mechanism illustrated. A particularly variable setting of the pivoting resistance is possible if the sliding bodies 165, 366 assigned to the individual spring elements 128 have bearing surfaces of differing steepness.

The described manner of setting the springs is in principle also usable in the mechanisms illustrated in FIGS. 3 to 8.

The following is a list of reference numerals and the corresponding elements illustrated in the drawing:

1 Chair pillar
2 Upper chair pillar end
3 Valve pin
4 Pivot axis
5 Chair longitudinal direction
6 Release direction
7 Pivot lever axis of rotation
8 Bolt longitudinal direction
9 Pneumatic spring longitudinal axis
10 Height adjustment
100 Chair
110 Seat
120 Rocking mechanism
121 Base support
122 Conical receptacle
123 Bolt
124 Bore
125 Separate mechanism upper part
126 Upper part side wall
127 Bearing
128 Compression spring
129 Elastomer cylinder
130 Function block
131 Screw
132 Threaded bore
140 Frame as mechanism upper part
141 Upper part side wall
142 Receiving opening
200 Pneumatic spring
210 Pressure housing
220 Blocking valve
300 Pivot lever
301 Release
302 Receiving sleeve
303 Lever arm
304 Bowden cable
305 Actuating lever
306 Bearing element
307 Base support side wall

308 Free end of the actuating lever
309 Movement for height adjustment
310 Lever end of the actuating lever
311 Bearing for actuating lever
312 Upper side of the release
313 Torsion spring
320 Blocking device
321 Blocking wedge
322 Blocking groove
323 Lower edge of the blocking wedge
324 Pivot axis of the blocking wedge
325 Upper edge of the blocking wedge
330 Actuating device
331 Transmission element
332 Actuating element
333 Movement for arresting the rocking function
334 Coupling piece
335 Coupling piece
340 Driver
341 Receptacle
342 Elongated hole
343 Latching recess
344 Latching step
345 Latching step
346 Latching element
347 Delimiting rib
348 Receiving pocket
350 Function block
351 Second Bowden cable
352 Pivot element
353 Limb of the function block
354 Spring element
360 spring adjustment device
361 Spring end
362 Spring plate
363 Spring bearing surface
364 Lower side of the spring plate
365 Sliding body on the spring plate
366 Sliding body on the base support
367 Hexagonal opening
368 Adjustment axis
369 Lifting distance
370 Base support lower side
371 Stop
372 Spring plate receptacle
373 Anti-buckling cylinder

The invention claimed is:

1. A chair with a rocking mechanism, comprising:

the rocking mechanism having a fixed base support with a conical receptacle formed for placing said base support on a chair pillar of the chair;

a mechanism upper part pivotally connected to said base support, said mechanism upper part forming a housing at least partially enclosing said base support;

said mechanism upper part being pivotable about a pivot axis running transversely with respect to a chair longitudinal direction and being arranged next to said conical receptacle, as seen in the chair longitudinal direction;

at least one spring element interacting with said mechanism upper part and with said base support for returning said mechanism upper part from a pivoted position into a starting position; and said mechanism upper part fastening said rocking mechanism to a seat, a seat support, or frame of the chair, or said rocking mechanism being integrated into the seat, the seat support, or the frame of the chair, with said mechanism upper part being formed by a part of the seat, the seat support, or the chair frame;

a valve pin for triggering a pneumatic spring placed in an interior of the chair pillar, said valve pin being located in a region of said conical receptacle; and a pivot lever for triggering said pneumatic spring by actuating said valve pin, said pivot lever interacting with at least a part of said rocking mechanism and having an axis of rotation coinciding with said pivot axis of said mechanism upper part.

2. The chair according to claim 1, wherein a position of said pivot axis of said mechanism upper part is defined by a bolt that is fixedly connected to said mechanism upper part and is mounted in a number of bearings provided on said base support, and wherein said pivot lever is pivotally mounted on said bolt.

3. The chair according to claim 2, which comprises a receiving sleeve for pivotally mounting said pivot lever on said bolt, said receiving sleeve being fixed in position between two of said bearings such that a release of said pivot lever, disposed on said receiving sleeve, is located directly above said valve pin.

4. The chair according to claim 1, which further comprises a device for blocking and releasing a rocking function of said rocking mechanism.

5. The chair according to claim 4, which comprises a single actuating element configured for actuating said pivot lever and for blocking and releasing the rocking function of said rocking mechanism.

6. The chair according to claim 1, which comprises a device for setting a pretensioning of said at least one spring element.

* * * * *